US005934102A

United States Patent [19]

DeKeuster et al.

[11] Patent Number: 5,934,102

[45] Date of Patent: Aug. 10, 1999

[54] INTEGRAL RECEIVER/CONDENSER FOR A REFRIGERANT

[75] Inventors: Richard M. DeKeuster; Lawrence W. Gabbey; Thomas J. Thielen, all of Racine; Michael J. Swee, Oak Creek; Mark G. Voss, Franksville, all of Wis.

[73] Assignee: Modine Manufacturing Company, Racine, Wis.

[21] Appl. No.: 09/020,210

[22] Filed: Feb. 6, 1998

[51] Int. Cl.[6] ..... F25B 39/04

[52] U.S. Cl. ..... 62/509; 62/503

[58] Field of Search ..... 62/474, 475, 503, 62/507, 509, 512

[56] References Cited

U.S. PATENT DOCUMENTS

| | | | |
|---|---|---|---|
| 4,019,337 | 4/1977 | Zearfoss | 62/113 |
| 4,651,540 | 3/1987 | Morse | 62/503 |
| 4,776,183 | 10/1988 | Okoma | 62/503 |
| 4,972,683 | 11/1990 | Beatenbough | 62/507 |
| 5,088,294 | 2/1992 | Ando | 62/119 |
| 5,159,821 | 11/1992 | Nakamura | 62/509 |
| 5,201,195 | 4/1993 | Gavlak et al. | 62/475 |
| 5,224,358 | 7/1993 | Yamanaka et al. | 62/509 |
| 5,228,315 | 7/1993 | Nagasaka et al. | 62/509 |
| 5,233,842 | 8/1993 | Manning et al. | 62/132 |
| 5,289,697 | 3/1994 | Hutchison | 62/474 |
| 5,394,710 | 3/1995 | Matsuo et al. | 62/509 |
| 5,419,141 | 5/1995 | Burk | 62/474 |
| 5,426,956 | 6/1995 | Phillippe | 62/509 |
| 5,435,149 | 7/1995 | Strong et al. | 62/218 |
| 5,505,253 | 4/1996 | Heraud | 165/110 |
| 5,537,839 | 7/1996 | Burk et al. | 62/474 |
| 5,546,761 | 8/1996 | Matsuo et al. | 62/509 |
| 5,560,214 | 10/1996 | Burk et al. | 62/129 |
| 5,582,027 | 12/1996 | Baba et al. | 62/509 |
| 5,592,830 | 1/1997 | Baba et al. | 62/509 |
| 5,619,861 | 4/1997 | Yamanaka et al. | 62/225 |
| 5,628,206 | 5/1997 | Baba | 62/507 |
| 5,666,791 | 9/1997 | Burk | 62/474 |

*Primary Examiner*—William Doerrler
*Attorney, Agent, or Firm*—Wood, Phillips, VanSanten, Clark & Mortimer

[57] ABSTRACT

Loss of efficiency as a result of inadequate subcooling caused by the entry of gaseous refrigerant into the subcooling stage of a condenser (20) from a receiver (22) is avoided in a construction wherein an upper inlet (64) to the receiver (22) is canted at an angle ($\alpha,\beta$) with respect to the longitudinal axis (74) of the receiver to induce a vortex flow (130) of refrigerant in the receiver (22). A baffle (106,115,118,121) may advantageously be located between the upper inlet (64) and a lower outlet (66) of the receiver (22) to isolate turbulence within the receiver (22) from the lower outlet (66).

22 Claims, 4 Drawing Sheets

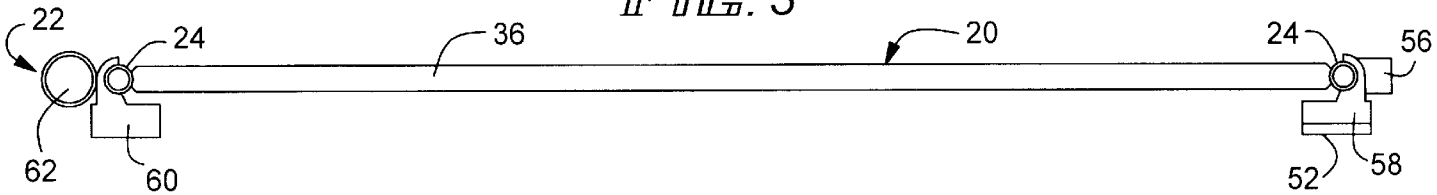
FIG. 3
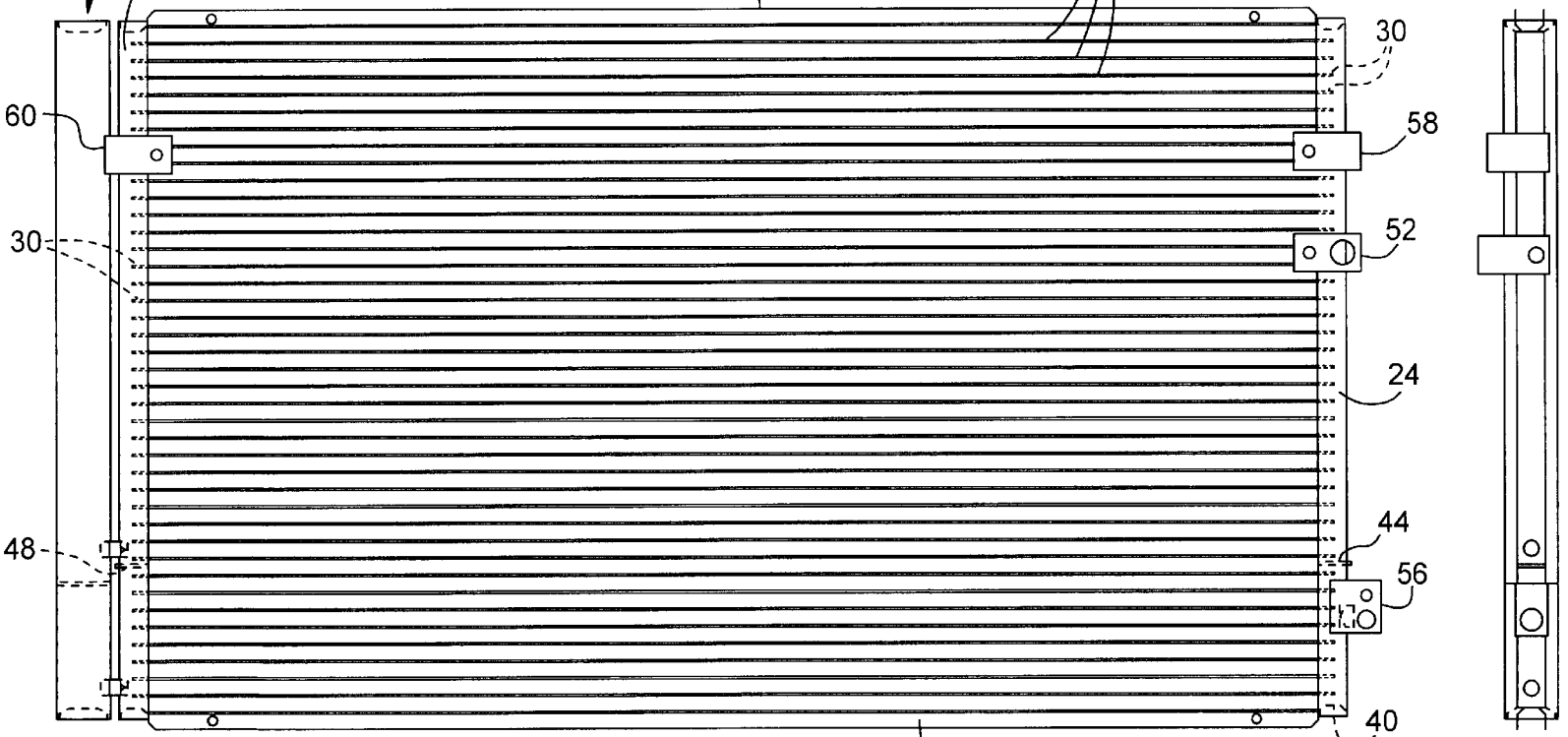
FIG. 4
FIG. 2

FIG. 5
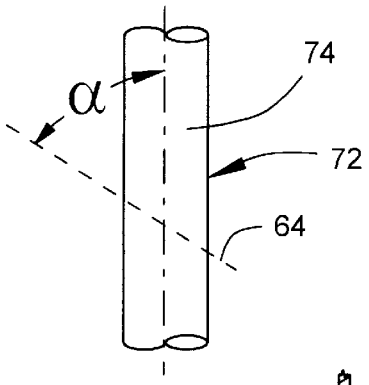
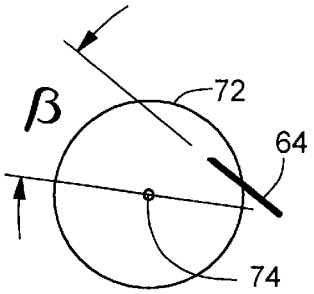
FIG. 6
FIG. 7
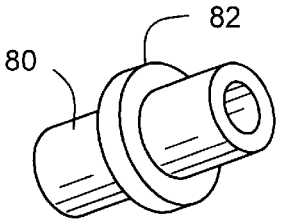
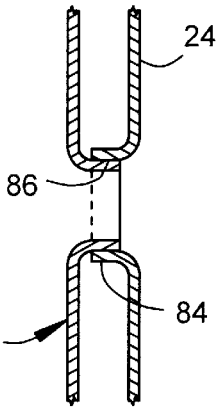
FIG. 8
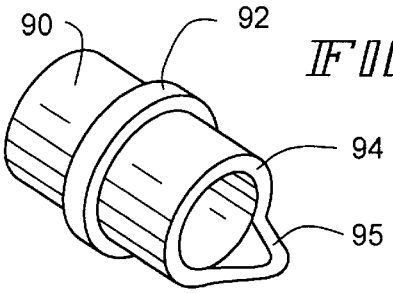
FIG. 9
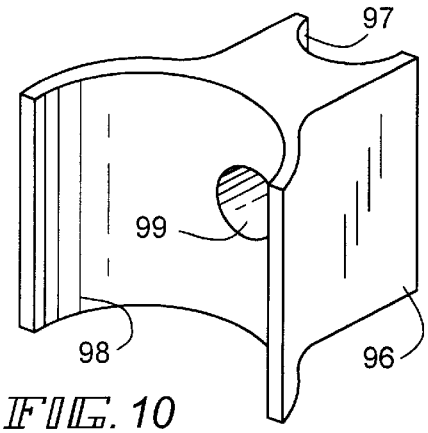
FIG. 10
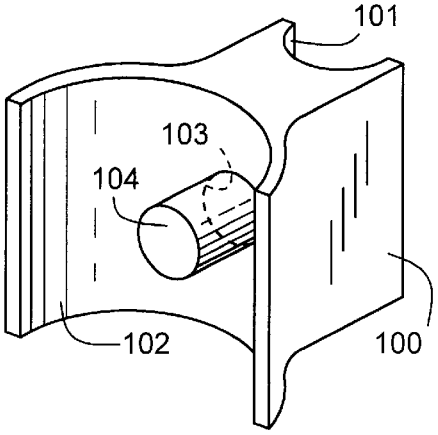
FIG. 11
FIG. 12
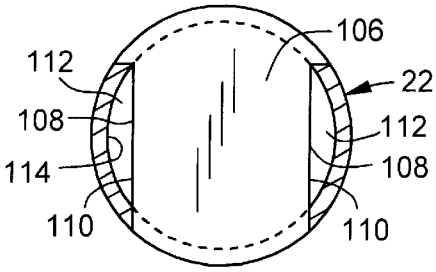

FIG. 16
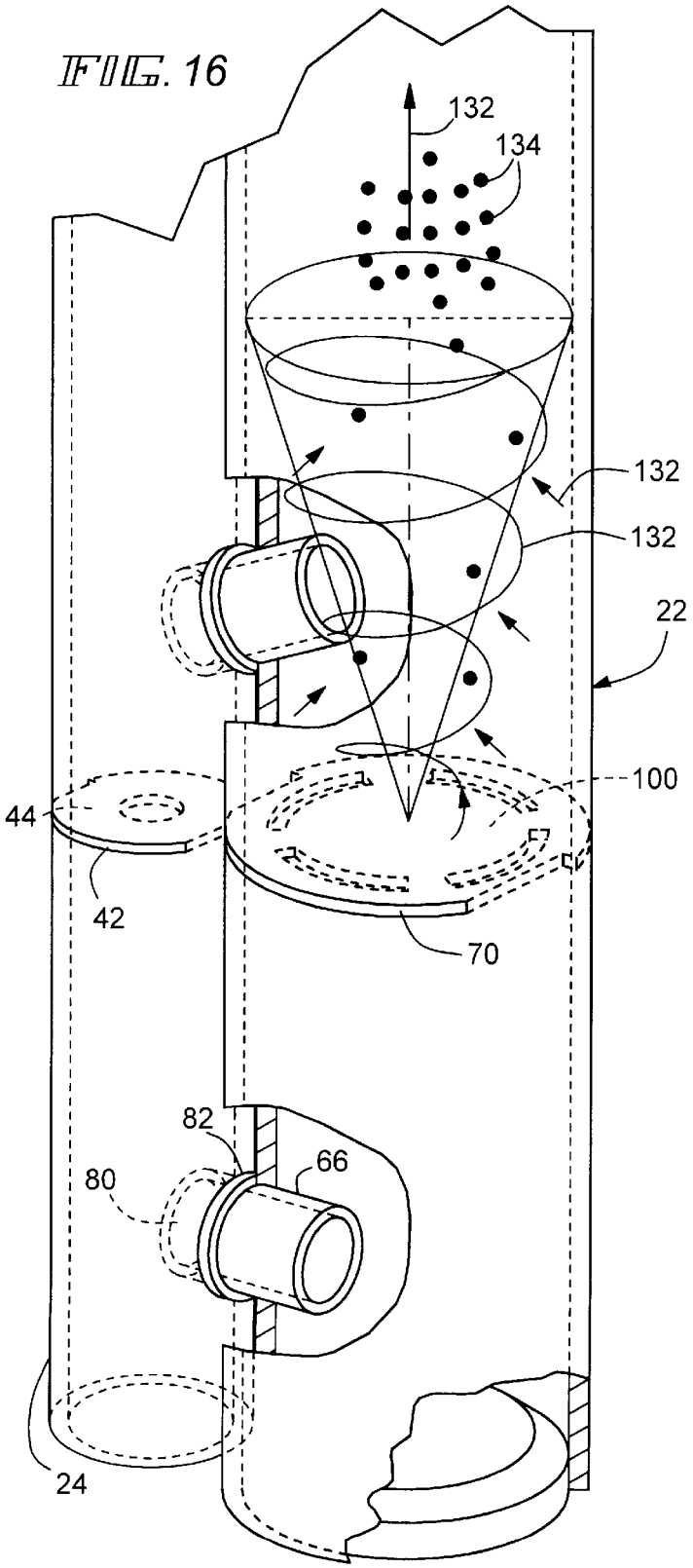
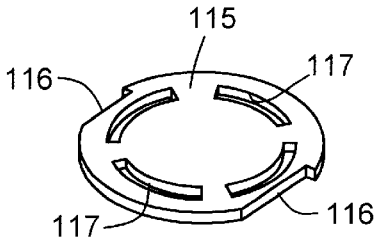
FIG. 13
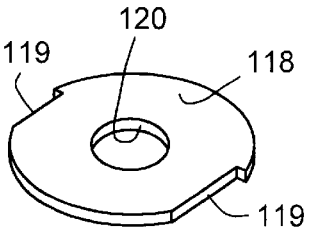
FIG. 14
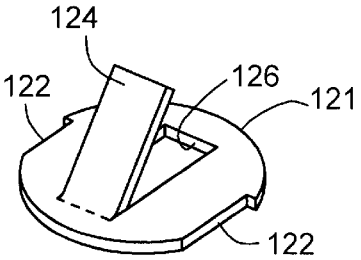
FIG. 15
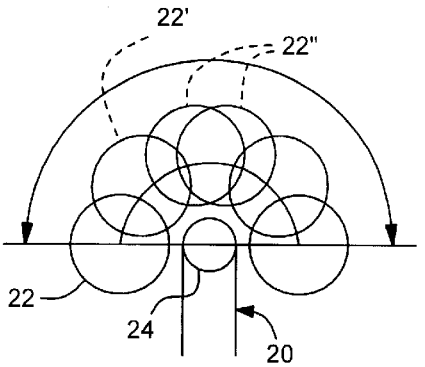
FIG. 17

INTEGRAL RECEIVER/CONDENSER FOR A REFRIGERANT

FIELD OF THE INVENTION

This invention relates to refrigeration systems such as air conditioning systems, and more specifically, to an integral receiver/condenser useful in such systems.

BACKGROUND OF THE INVENTION

Vapor compression refrigeration systems conventionally employ a condenser which receives a refrigerant in the vapor phase under relatively high pressure from a compressor. The condenser is operative to condense the refrigerant vapor to the liquid phase for ultimate transmittal to an evaporator whereat the refrigerant evaporates. Heat from the ambient is rejected to the refrigerant where it is absorbed as the latent heat of vaporization as the refrigerant evaporates. The now vaporized refrigerant is then directed to the compressor to be recycled through the system.

Conventionally such systems include a so-called receiver which is intended to receive liquid refrigerant from the condenser before it is transmitted to the evaporator. The primary purpose of the receiver is to assure that all refrigerant passed to an expansion device upstream of the evaporator is in the liquid phase. This means that the refrigerant quality is low and its enthalpy is also low to increase the evaporator's ability to absorb heat as the refrigerant evaporates. In this connection, the receiver acts as a reservoir for excess liquid refrigerant to assure that only liquid is fed to the expansion device in spite of system changes typically caused by the operation of the compressor. For example, in an automotive air conditioning system, the compressor is frequently stopped and started. Furthermore, when the engine to which the compressor is typically mechanically coupled is accelerating, compressor speed may also change, causing a change in the pressure at its inlet which in turn affects the flow rate of refrigerant in the system.

In addition, receivers may also be provided with a means for filtering the refrigerant as well as for drying the refrigerant to assure its purity, thereby avoiding inefficient operation.

It is desirable to integrate the receiver with the condenser in many instances. For example, in so-called parallel flow condensers of the multipass type, integration of the receiver with the condenser assures that only liquid refrigerant will be fed to the last pass of the condenser which then acts solely as a subcooling pass. When such is accomplished, the increased subcooling further lowers the refrigerant quality while reducing the enthalpy of the refrigerant delivered to the evaporator to achieve the efficiencies mentioned earlier. Moreover, integration of the receiver with the condenser eliminates the need for a separate receiver/dryer elsewhere in the system and has the ability to reduce the total cost of the system as well as the quantity of refrigerant that must be charged into the system.

In this latter respect, it is well known that certain refrigerants are not environmentally friendly. For example, CFC 12 is thought to degrade the protection ozone layer surrounding the earth. Other refrigerants such as HFC 134a, while less damaging of the ozone layer, are thought to contribute to the so-called greenhouse effect which may be responsible for global warming.

Because in automotive air conditioning systems, the compressor is driven by the vehicle engine, it cannot be hermetically sealed as in residential or commercial air conditioning units. As a consequence, there is the potential for escape of the refrigerant through compressor seals with the resulting deleterious effects on the environment. Thus, refrigerant charge volume is of substantial concern.

In U.S. Pat. No. 5,546,761 issued Aug. 20, 1996 to Matsuo et al, there is disclosed an integrated receiver/condenser. One difficulty with the type of system disclosed in that patent is that turbulence may be induced within the receiver. The turbulence may be induced by the incoming refrigerant which typically will be a mixture of vapor and liquid phase refrigerant. Another source of turbulence, particularly when the receiver/condenser is employed in a vehicular air conditioning system, is vehicular speed changes. As the vehicle accelerates or decelerates, liquid refrigerant within the receiver may undergo substantial shifts in its position in relation to the receiver outlet.

When such turbulence is present, it is possible for refrigerant as a mixture of liquid and vapor to reach the receiver outlet. When that occurs, the last pass of the condenser is no longer exclusively a subcooling pass. Rather, it will not only act to subcool that refrigerant that is in the liquid phase, but it will act to condense that refrigerant which is in the vapor phase. As a consequence, the optimal degree of subcooling cannot be achieved and system operation suffers.

The present invention is directed to overcoming one or more of the above problems.

SUMMARY OF THE INVENTION

It is a principal object of the invention to provide a new and improved integrated receiver/condenser for use in a refrigeration system. Typically, but not always, the improved receiver/condenser will be employed in an automotive air conditioning system.

According to the invention, a condenser for a refrigerant is provided and includes two spaced, non-horizontal, elongated headers. Tube slots are in the facing sides of the headers with the tube slots in one header being generally aligned with the tube slots in the other head. A plurality of tubes extend between the headers with their ends in corresponding ones of the slots to establish a plurality of hydraulically parallel flow paths between the headers. At least one partition is located at each of the headers for causing refrigerant to make at least two passes, including a first pass and a last pass, through the condenser. A refrigerant inlet is located in one of the headers and communicates with the first pass. A refrigerant outlet is also located in one of the headers and communicates with the last pass. An elongated receiver is mounted on one of the headers and has a longitudinal axis. The receiver has a lower liquid outlet connected to an upstream side of the last pass and an upper inlet connected to a downstream side of the first pass. The upper inlet and lower outlet, at their connections to the header on which the receiver is mounted, are separated by one of the partitions.

According to one facet of the invention, the upper inlet is canted with respect to the longitudinal axis of the receiver to induce a vortex flow of refrigerant in the receiver, while according to another embodiment of the invention, the upper inlet is also canted to one side of the longitudinal axis. In a highly preferred embodiment of the invention, the upper inlet is canted upwardly toward the longitudinal axis and is also canted to one side of the longitudinal axis.

As a result of this construction, a vortex flow of refrigerant occurs in the receiver which tends to cause a separation of the higher density liquid refrigerant from the lower density vaporous refrigerant. Gravity then causes the dense liquid refrigerant to move downwardly toward the lower outlet.

According to another embodiment of the invention, the condenser is provided with elongated headers, tube slots, a plurality of tubes, at least one partition in each header, a refrigerant inlet, a refrigerant outlet and an elongated receiver having an upper inlet and a lower outlet as before. In this embodiment of the invention, a perforate baffle is located within the receiver at a location between the upper inlet and the lower outlet and serves to maintain separation of liquid refrigerant from refrigerant in the vapor phase.

In one embodiment of the invention, a detachable cap is provided for the receiver so as to allow the installation of a filter and/or conventional drying material within the receiver.

Other objects and advantages will become apparent from the following specification taken in connection with the accompanying drawings.

BRIEF DESCRIPTION OF THE DRAWINGS

FIG. 2 is a front elevation of the receiver/condenser;

FIG. 3 is a plan view of the receiver/condenser;

FIG. 4 is a side elevational view of the receiver/condenser;

FIG. 5 is a somewhat schematic elevational view of the receiver inlet;

FIG. 6 is a somewhat schematic plan view of the receiver inlet;

FIG. 7 illustrates one means for mounting the receiver on a condenser;

FIG. 8 illustrates another means of mounting the receiver on a condenser;

FIG. 9 illustrates still another means for mounting the receiver on a condenser and for directing incoming refrigerant in a desired path;

FIG. 10 is a perspective view of still another means for mounting the receiver on a condenser;

FIG. 11 is a perspective view of a mounting means similar to that shown in FIG. 10 but additional including means for directing the incoming refrigerant in a desired path;

FIG. 12 illustrates a baffle that may be employed in the receiver;

FIG. 13 illustrates another form of the baffle;

FIG. 14 illustrates still another form of a baffle;

FIG. 15 is a sectional view of still another form of a baffle;

FIG. 16 is a fragmentary perspective of refrigerant flow as it enters the receiver; and FIG. 17 is a schematic illustrating a variety of positions in which the receiver may be mounted on the condenser.

DESCRIPTION OF THE PREFERRED EMBODIMENTS

Figure 1:
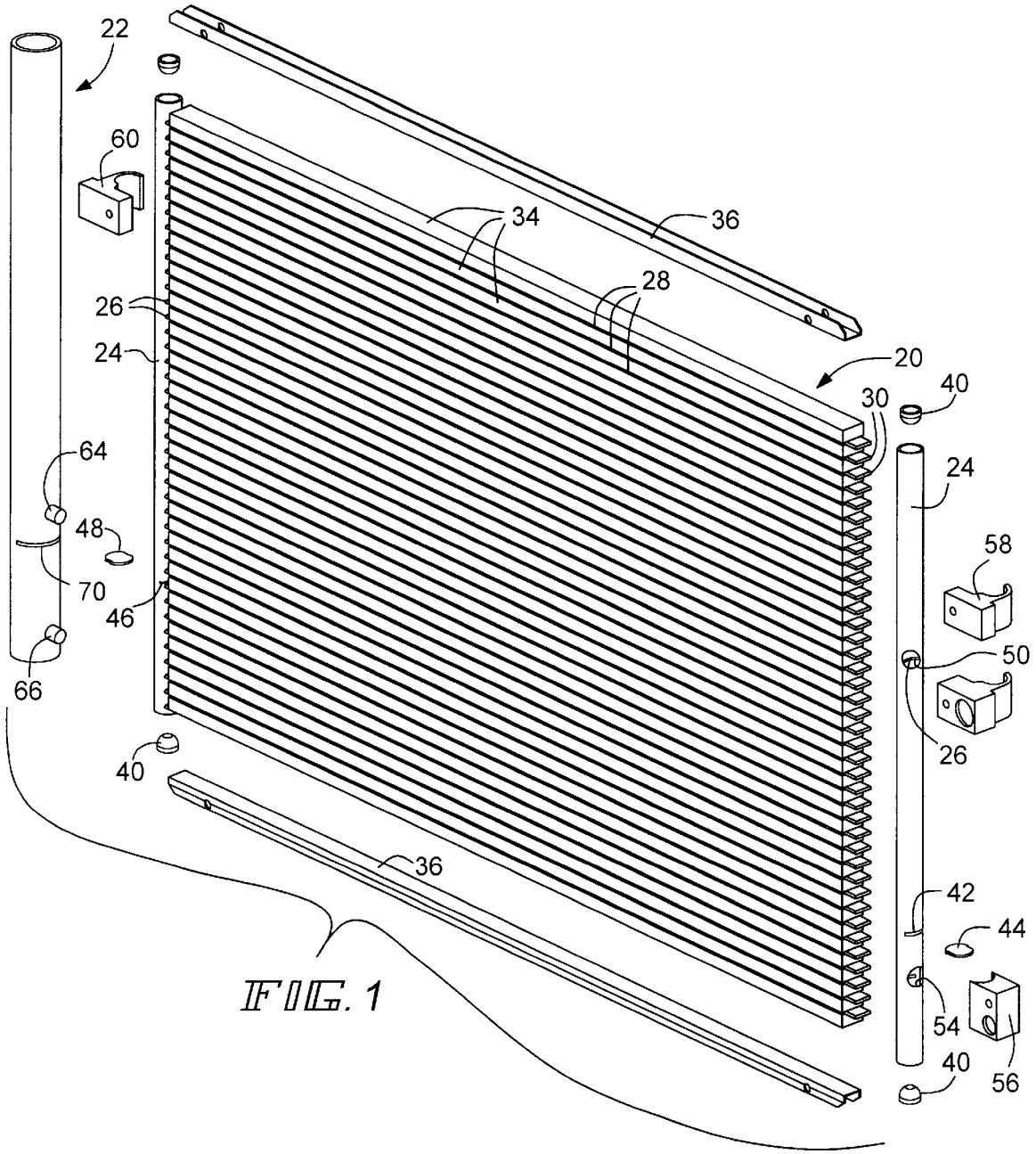
FIG. 1 is an exploded view of an integrated receiver/condenser made according to the invention.

Exemplary embodiments of an integrated receiver/condenser are illustrated in the drawings and with reference to FIGS. 1–4 inclusive, are seen to include a condenser, generally designated 20 and a receiver, generally designated 22 mounted thereon in substantial abutting relation therewith. The condenser includes tubular, elongated, vertically oriented headers 24. Each header 24 on its side facing the other includes a plurality of tube slots 26 which are aligned with the tube slots 26 in the opposite header. A plurality of multiport flattened tubes 28 extend between the headers 24 and have their ends 30 received in sealed relation in corresponding ones of the slots 26. In the usual case, the components will be made of aluminum and are bonded together as by brazing.

Serpentine fins 34, shown only schematically in the figures, extend between adjacent ones of the tubes 28 and, at the sides of the condenser 20, side plates 36.

The ends of the tubular headers 24 are sealed as by end plugs 40 which are typically brazed in place.

The embodiment illustrated is intended to be a two pass condenser and to this end, near its lower end, includes a double slot 42 which receives an imperforate partition or baffle 44. In a preferred embodiment, the slot 42 and baffle 44 are formed generally in the fashion shown in FIGS. 1–6 of commonly assigned U.S. Pat. No. 4,936,381 issued on Jun. 26, 1990 to Alley, the entire disclosure of which is herein incorporated by reference.

The opposite header 24 includes a similar slot 46 which receives a baffle 48 which is also generally the same as the baffle 44. In the embodiment illustrated, the slots 42 and 46 are at the same location on their respective headers.

The rightmost header 24 includes an inlet opening 50 to which an inlet fixture 52 is brazed. The fixture 52 serves as the point of connection of the condenser into the system and it will be seen that the same is above the baffle 44.

Below the baffle, the rightmost header 24 includes a second opening 54 which in turn receives an outlet fixture 56 which serves as the outlet from the receiver/condenser to the system.

If desired, a mounting fixture 58 may also be brazed to the rightmost header 24. A similar fixture 60 may be brazed to the leftmost header 24.

The receiver 22 is cylindrical and of generally the same length as the headers 24. It is of a larger diameter so as to provide sufficient volume to store the necessary amount of refrigerant as the system requires.

As its upper end, the receiver 22 is closed by a threaded cap 62. The cap 62 is thus removable and serves as a means whereby, after assembly of the receiver/condenser, a filter and/or a conventional drying material may be introduced into the receiver 22.

Near its lower end, the receiver 22 includes an upper refrigerant inlet 64 and a lower refrigerant outlet 66. As illustrated in FIG. 1, the upper inlet 64 and lower outlet 66 are in the form of nipples which may be sealingly received in aligned openings in the leftmost header 24. The arrangement is such that the upper inlet 64 will be above the partition 48 while the lower outlet 66 will be below the partition 48.

It will thus be appreciated that a two pass condenser is defined. Specifically, refrigerant may enter through the fixture 52 and be distributed by the header 24 to the tube ends 30 that are above the partition 44 to flow to the leftmost header. Once the refrigerant enters the leftmost header 24, it may exit the same via the upper inlet 64 to the receiver 22. After the mixture of liquid and vapor phase refrigerant is separated within the receiver 22, liquid refrigerant may exit the receiver 22 via the lower outlet to ultimately be returned to the rightmost header 24 via those tubes 28 that are located below the partitions 44 and 48. During this pass, the liquid will be subcooled as desired and ultimately will be returned to the system via the fitting 56. Of course, it should be understood that the invention is not limited to any specific number of passes although it will always be employed in a condenser having at least two passes.

Returning to the receiver 22, between the upper inlet 64 and the lower outlet 66, the same includes a baffle receiving slot 70 for purposes to be seen.

Turning now to FIGS. 5 and 6, the orientation of the upper inlet 64 and the receiver 22 will be described. A cylindrical tube defining the receiver 22 is shown at 72, albeit somewhat schematically and its longitudinal axis is designated 74. Referring to FIG. 5 specifically, it will be seen that the inlet 64 is canted at an acute angle α with respect to the longitudinal axis 74. In particular, the inlet 64 is canted upwardly with respect to the axis 74.

As seen in FIG. 6, the inlet 64 may be alternatively or additively canted to one side of the longitudinal axis 64 by an angle β. As will be seen in greater detail hereinafter, this configuration causes the generation of a vortex of the incoming mixed phase refrigerant. The vortex is much the same as that found in a cyclone separator with the higher density liquid refrigerant being centrifugally flung against the interior wall of the receiver 22 to drain under the influence of gravity toward the lower outlet 66. The lesser density vaporous refrigerant remains in the receiver 22 until it condenses as a result of heat exchange though the receiver wall or as a result of contact with incoming liquid refrigerant that may be partially subcooled.

FIG. 7 illustrates one form of a nipple that may be used in making one or both of the upper inlet 64 and lower outlet 66. Specifically, the same is no more than a short section of tube 80 with a peripheral rib 82 about its center. The rib 82 prevents either end of the tube 80 from extending too far into either the leftmost header 24 or the receiver 22.

As an alternative to the use of the tube, conventional T-drilling may be employed as illustrated in FIG. 8 to form a flange 84 extending outwardly from the header 24 to peripherally embrace a somewhat smaller flange 86 in the wall of the receiver 22. The flanges 84 and 86 are united and sealed during the brazing operation.

FIG. 9 illustrates still another form of means by which the receiver 22 may be mounted on the condenser 20. Like FIG. 7, a short section of tube 90 is employed and the same is provided with a generally central, peripheral rib 92 having the same function as the rib 82. However, on that end 94 of the tube 90 that is to enter the receiver 22, an upturned lip or projection 95 is provided. By suitably orienting the tube 90 at the time of initial assembly, the lip 95 may be made to direct incoming mixed refrigerant at the angle α or at the angle β, or both. Alternatively, when the using the tube 80, the same may simply be skewed somewhat to provide either or both of the angles α and β by appropriately directioning the bores in the receiver 22 and the header 24 in which the same is received.

FIG. 10 shows still another form of a means by which the receiver 22 may be mounted on the condenser 20. A saddle-like mounting block 96 is employed and the same includes first and second semicylindrical recesses 97 and 98. The recess 97 is of the same diameter as the outside diameter of the header 24 while the recess 98 is of the same diameter as the outside diameter of the receiver 22. Interconnecting recesses 98 and 97 is a bore 99. In this embodiment of the invention, the tube 80 may done away with entirely with the ends of the bore 99 respectively aligned with the openings in the receiver 22 and the header 24 that are normally occupied by the tube 80. When the assembly is brazed together, braze metal will provide a seal around the ends of the bore 99 to make the junction fluid tight.

FIG. 11 shows still another form of a means by which the receiver 22 may be mounted on the condenser. Again, a saddle like mounting block 100 is employed and again, the same has oppositely directed recesses 101 and 102 which are semicylindrical and which are dimensioned just as the recesses 97 and 98. A bore 103 connects the recesses 101 and 102 just as the bore 99. In this embodiment, however, a short length of tube 104 is inserted in the end of the bore 103 opening to the recess 102. The tube 104 is sized so as to enter the opening in the receiver 22 that would otherwise be occupied by the tube 80.

Whereas the bore 99 is generally formed to intersect the longitudinal axis 74 of the receiver 22 at mutually perpendicular right angles, that may or may not be true of the bore 103.

For example, the bore 103 may be angled such that the tube 104 will enter the receiver 22 at an angle canted with respect to the longitudinal axis 74, the angle being either the angle α (FIG. 5) or the angle β (FIG. 6) or both to provide a desired vortex action as explained previously.

Returning to FIG. 1, it will be recalled that a slot 70 is provided in the receiver 22. In fact, the slot 70 is a double slot much like that shown in the previously identified Alley patent and is intended to receive a baffle configured generally in the form illustrated by Alley.

FIG. 12 illustrates a preferred form of the baffle and the same is seen to include a generally circular plate 106 with opposed, L-shaped notches 108 in its opposite sides. Whereas the baffle disclosed by Alley spaces the notches 108 a distance approximately equal to the inside diameter of the tube, in the baffle illustrated in FIG. 12, the long sides 110 of the notches 108 are spaced a distance less than the internal diameter of the receiver 22 so as to leave a pair of elongated openings 112 between the inner tube wall 114 of the receiver 22 and the long sides 110. The openings 112 serve as drain holes whereby liquid refrigerant may drain from that part of the receiver 24 above the baffle 106 toward the lower outlet 66 while the main body of the baffle plate 106 serves to isolate any turbulence occurring in the vicinity of the upper inlet 64 from the liquid adjacent the lower outlet 66.

FIG. 13 illustrates another form of the baffle as being made of a generally circular plate 115 having two L-shaped notches 116 cut in the sides thereof for the purposes mentioned by Alley. The plate 115 is provided with a plurality of elongated slots 117 near its periphery. The slots 117 are arcuate. Just as in the FIG. 12 embodiment, they serve as drain holes whereby liquid refrigerant may drain from that part of the receiver 24 above the baffle 115 toward the lower outlet 66 while the main body of the baffle plate 115 serves to isolate any turbulence occurring in the vicinity of the upper inlet 64 from the liquid adjacent the lower outlet 66.

FIG. 14 illustrates another form of a baffle which again includes a generally circular plate 118 provided with L-shaped cutouts 119 in opposite sides for the same purpose as disclosed by Alley. A generally central, circular aperture 1 20 is provided to serve the same functions as the slots 117.

Still another form of the baffle received in the slot 70 is illustrated in FIG. 15. Again, a plate 121 is employed and is provided with L-shaped notches 122 like those illustrated at 116 and 119. In the center of the plate 121, a tab 124 is displaced from the body of the plate 121 to leave an opening 126. The opening 126 serves as a drain hole much like the slots 117 or the aperture 120. The tab 124 may be oriented to be in the path of the incoming stream, that is, in the discharge path of, for example, the opening defined by the flanges 84,86 or the end of the tube 80 within the receiver to provide a desired deflection of the incoming mixed refrigerant stream at the angles α or β or both.

Reference is made to FIG. 16. In this embodiment, the tube 80 is employed as the upper inlet 64 and as can be seen, is canted in the manner mentioned in connection with FIGS. 5 and 6. The vortex of the incoming refrigerant is illustrated by an upwardly spiraling arrow 130 which illustrates the path taken by the liquid refrigerant. Arrows 132 and dots 134 illustrate the path taken by the gaseous refrigerant.

As can be readily appreciated, the baffle 100 acts to effectively segregate any turbulence as a result of the incoming stream or that may be generated by movement of the receiver 22, as when in a vehicle, from the lower outlet 66.

In some instances, the baffle 100 may be omitted while in others, the baffle 100 may be retained and the canting of the upper inlet 64 omitted.

Still another advantage of the construction of the invention is illustrated in FIG. 17. It will be appreciated that by appropriately locating the holes or openings for the connection of the receiver 22 to the header 24, the receiver 22 may be located in any of a plurality of positions spaced as many as 180° about the header 24 as illustrated by the positions shown at 22, 22' or 22". Thus, depending upon the available space at a given installation, the position of the receiver with respect to the body of the condenser may be varied substantially to accommodate special spatial requirements.

We claim:

1. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers to said first pass;

a refrigerant outlet in one of said headers from said last pass;

an elongated receiver mounted on one of said headers and having a longitudinal axis;

said receiver having a lower liquid outlet connected to an upstream side of said last pass and an upper inlet connected to a downstream side of said first pass, said upper inlet and said lower inlet, at their connections to the header on which the receiver is mounted being separated by one of said partitions;

said upper inlet being canted upwardly toward said longitudinal axis of said receiver to induce a vortex flow of refrigerant.

2. The condenser of claim 1 wherein said upper inlet is additionally canted to one side of said longitudinal axis.

3. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers to said first pass;

a refrigerant outlet in one of said headers from said last pass;

an elongated receiver mounted on one of said headers and having a longitudinal axis;

said receiver having a lower liquid outlet connected to an upstream side of said last pass and an upper inlet connected to a downstream side of said first pass, said upper inlet and said lower inlet, at their connections to the header on which the receiver is mounted being separated by one of said partitions;

said upper inlet being canted with respect to said longitudinal axis of said receiver to induce a vortex flow of refrigerant, and said upper inlet including an inlet tube interconnecting said header to which the receiver is mounted and said receiver.

4. The condenser of claim 3 wherein said inlet tube terminates in said receiver with an end having a diverter configured to cant said upper inlet with respect to said longitudinal axis.

5. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers to said first pass;

a refrigerant outlet in one of said headers from said last pass;

an elongated receiver mounted on one of said headers and having a longitudinal axis;

said receiver having a lower liquid outlet connected to an upstream side of said last pass and an upper inlet connected to a downstream side of said first pass, said upper inlet and said lower inlet, at their connections to the header on which the receiver is mounted being separated by one of said partitions;

said upper inlet being canted with respect to said longitudinal axis of said receiver to induce a vortex flow of refrigerant; and a generally horizontal baffle within and extending across said receiver and located between said upper inlet and said lower outlet.

6. The condenser of claim 5 wherein said baffle includes a generally central opening.

7. The condenser of claim 5 wherein said baffle includes a plurality of slots or openings at or near its periphery.

8. The condenser of claim 7 wherein said receiver is cylindrical and the slots in said baffle are arcuate.

9. The condenser of claim 7 wherein said plurality of slots or openings are defined by notches in the periphery of said baffle.

10. The condenser of claim 5 wherein said baffle includes a tab displaced to one side of the baffle.

11. The condenser of claim 10 wherein said tab is displaced toward said upper inlet.

12. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers to said first pass;

a refrigerant outlet in one of said headers from said last pass;

an elongated receiver mounted on one of said headers and having a longitudinal axis;

said receiver having a lower liquid outlet connected to an upstream side of said last pass and an upper inlet connected to a downstream side of said first pass, said upper inlet and said lower inlet, at their connections to the header on which the receiver is mounted being separated by one of said partitions;

said upper inlet being canted with respect to said longitudinal axis of said receiver to induce a vortex flow of refrigerant; and said refrigerant inlet and outlet each being defined by a short tube additionally serving to mount said receiver on the header on which it is mounted.

13. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers to said first pass;

a refrigerant outlet in one of said headers from said last pass;

an elongated receiver mounted on one of said headers and having a longitudinal axis;

said receiver having a lower liquid outlet connected to an upstream side of said last pass and an upper inlet connected to a downstream side of said first pass, said upper inlet and said lower inlet, at their connections to the header on which the receiver is mounted being separated by one of said partitions;

said upper inlet being canted with respect to said longitudinal axis of said receiver to induce a vortex flow of refrigerant; and at least one apertured saddle block interposed between the receiver and the header on which it is mounted and connecting the same to one of said lower liquid outlet and upper liquid inlet.

14. A condenser for a refrigerant comprising:

two spaced, (nonhorizontal) generally vertically elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers from said last pass;

an elongated, generally vertical receiver mounted on one of said headers, said receiver having a lower liquid outlet connected to an upstream side of said last pass and an upper inlet connected to a downstream side of said first pass, said upper inlet and said lower outlet, at their connections to the header on which the receiver is mounted being separated by one of said partitions; and a generally horizontal baffle with said receiver and located between said upper inlet and said lower outlet.

15. The condenser of claim 14 wherein said baffle is a perforated plate.

16. The condenser of claim 15 wherein said baffle includes a generally central opening.

17. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including a first pass and a last pass, through said condenser;

a refrigerant inlet in one of said headers from said last pass;

an elongated receiver mounted on one of said headers, said receiver having a lower liquid outlet connected to an upstream side of said last pass and an upper inlet connected to a downstream side of said first pass, said upper inlet and said lower outlet, at their connections to the header on which the receiver is mounted being separated by one of said partitions; and a baffle with said receiver and located between said upper inlet and said lower outlet, said baffle including at least one slot or opening at or near its periphery.

18. The condenser of claim 17 wherein said receiver is cylindrical and the slots in said baffle are arcuate.

19. The condenser of claim 17 wherein said slot or opening is defined by a notch in the periphery of said baffle.

20. The condenser of claim 17 wherein there are a plurality of said slots or openings.

21. The condenser of claim 15 wherein said baffle includes a tab displaced to one side of the baffle.

22. The condenser of claim 21 wherein said tab is displaced toward said upper inlet.

* * * * *

UNITED STATES PATENT AND TRADEMARK OFFICE

CERTIFICATE OF CORRECTION

PATENT NO. : 5,934,102
DATED : August 10, 1999
INVENTOR(S) : Richard M. DeKeuster et al.

It is certified that error appears in the above-identified patent and that said Letters Patent is hereby corrected as shown below:

Column 7,
Line 46, change "inlet" (second occurrence) to -- outlet --.

Column 8,
Line 8, change "inlet" (second occurrence) to -- outlet --.
Line 43, change "inlet" (second occurrence) to -- outlet --.

Column 9,
Line 20, change "inlet" (second occurrence) to -- outlet --.
Line 51, change "inlet" (second occurrence) to -- outlet --.
Line 62, delete "(nonhorizontal)"

Column 10,
Line 21, change "with" to -- within --.
Line 48, change "with" to -- within --.

Signed and Sealed this

Thirty-first Day of July, 2001

Nicholas P. Godici

*Attest:*

*Attesting Officer*

NICHOLAS P. GODICI
*Acting Director of the United States Patent and Trademark Office*